US006945738B2

(12) United States Patent
O'Quinn et al.

(10) Patent No.: US 6,945,738 B2
(45) Date of Patent: Sep. 20, 2005

(54) METHOD AND APPARATUS FOR SAFETY PROTECTION OF TEMPORARY ROOF SUPPORT

(75) Inventors: Roger O'Quinn, Blacksburg, VA (US); David Wallace, West Frankfort, IL (US); Michael Twigger, Blacksburg, VA (US); Chitra Ranganathan, Blacksburg, VA (US)

(73) Assignee: DBT America, Pittsburgh, PA (US)

( * ) Notice: Subject to any disclaimer, the term of this patent is extended or adjusted under 35 U.S.C. 154(b) by 0 days.

(21) Appl. No.: 10/680,814

(22) Filed: Oct. 7, 2003

(65) Prior Publication Data

US 2005/0073189 A1 Apr. 7, 2005

(51) Int. Cl.[7] ..... E21D 9/06
(52) U.S. Cl. ..... 405/302; 299/1.05
(58) Field of Search ..... 187/281, 286; 248/550; 700/275; 299/1.05, 1.3, 1.4, 1.7; 405/272, 288, 290–302

(56) References Cited

U.S. PATENT DOCUMENTS

| | | | | |
|---|---|---|---|---|
| 394,952 A | * | 12/1888 | Baxter | 187/277 |
| 1,613,215 A | * | 1/1927 | Albersheim et al. | 187/281 |
| 2,774,437 A | * | 12/1956 | Remde | 180/282 |
| 3,341,843 A | | 9/1967 | Walsh | |
| 3,447,328 A | | 6/1969 | Schuermann | |
| 3,600,938 A | | 8/1971 | Waddell et al. | 73/88 |
| 3,672,174 A | * | 6/1972 | Von Hippel | 405/295 |
| 4,091,628 A | | 5/1978 | Kelley | 61/45 |
| 4,378,027 A | | 3/1983 | Weirich et al. | 137/596.16 |
| 4,505,622 A | | 3/1985 | Asszonyi et al. | 405/288 |
| 4,552,488 A | * | 11/1985 | Elliott-Moore | 405/299 |
| 4,622,998 A | | 11/1986 | Kussel et al. | 137/596.15 |
| 4,913,499 A | | 4/1990 | Smart | 299/12 |
| 5,312,206 A | | 5/1994 | Gaskins | 405/291 |
| 5,423,638 A | | 6/1995 | Merriman | 405/292 |
| 5,454,669 A | * | 10/1995 | Oziem et al. | 405/302 |
| 5,462,391 A | | 10/1995 | Castle et al. | 405/302.2 |
| 5,668,325 A | | 9/1997 | Hart et al. | 73/81 |
| 5,789,887 A | * | 8/1998 | Elischewsik | 318/468 |
| 6,056,481 A | * | 5/2000 | Watermann et al. | 405/294 |

FOREIGN PATENT DOCUMENTS

WO WO 01/63095 A1 8/2001

* cited by examiner

*Primary Examiner*—John Kreck
(74) *Attorney, Agent, or Firm*—Coudert Brothers LLP

(57) ABSTRACT

Embodiments of the present invention are directed to a method and apparatus for safety protection control of temporary roof support. In one embodiment, a temporary roof support has a load sensing member. In another embodiment, a beam structure of temporary roof support is supported by a load sensing pin. Strain gages are installed within the pin to measure the load placed upon the pin. An unusually high load being sensed by the pin indicates that the roof has fractured and the temporary roof support is supporting loose rock. In one embodiment, when an unusually high load is measured at the pin, the temporary roof support controls at the front of the machine are disabled. A second set of remotely located temporary roof support controls remain operative. In one embodiment, the second set of controls is located at the rear of the machine.

14 Claims, 12 Drawing Sheets

METHOD AND APPARATUS FOR SAFETY PROTECTION OF TEMPORARY ROOF SUPPORT

BACKGROUND OF THE INVENTION

1. Field of the Invention

The present invention relates to the field of load-bearing hydraulics, and in particular to a method and apparatus for safety protection control of temporary roof support.

2. Background Art

In mining operations, roof fall situations are of pressing concern. Safety precautions are taken to prevent personnel being injured by roof falls, including adding support structures to the roof bolter equipment. However, prior art methods of adding structural support remain dangerous for those installing the support. This problem can be better understood with a review of temporary roof supports.

Temporary Roof Supports

A temporary roof support is used to support the roof of an excavated location during installation of permanent roof support (e.g., operation of roof bolters). In one common arrangement, a dual boom roof bolter has two operators and two sets of controls for installing roof bolts. Typically, each operator is responsible for bolting one half of an entry way. Frequently, one operator also has controls on the boom to lower and raise a temporary roof support as well as to move the machine at a reduced rate of speed. Such controls are used in repositioning the machine after each row of bolts across an entry is installed.

However, under certain roof conditions, the roof may fracture while temporary roof support is supporting the roof. An operator may or may not be aware that such a fracture has occurred. During typical operation of roof bolters, the roof bolts are installed at approximately four foot intervals. Thus a large amount of rock may be broken loose between installed roof bolts and be supported solely by the temporary roof support.

Loose rock causes at least three potential hazards. First, the controls of the temporary roof support are located near the front of the roof bolter. Thus, an operator is exposed to falling rock when the temporary roof support is released. Second, a temporary roof support is supported by hydraulic cylinders with load holding valves. The speed of the decent of the temporary roof support is dependent only upon the load applied and the restrictions in the hydraulic circuit. Thus, the temporary roof support may descend at a rate that is hazardous to the operator, even though the loose rock is not free-falling. Additionally, the strain on the hydraulic circuit resulting from the rapid decent may cause damage to the temporary roof support.

SUMMARY OF THE INVENTION

Embodiments of the present invention are directed to a method and apparatus for safety protection control of temporary roof support. In one embodiment of the present invention, a temporary roof support has a load sensing member. In a non-limiting exemplary embodiment, a beam structure of a temporary roof support is supported by a load sensing pin. The pin may be positioned at the center of the beam structure and may also be positioned on a radial ball bearing. The pin enables the beam to pivot to adapt to the inclination of the roof. In one embodiment, all loads experienced by the temporary roof support are transmitted through the pin. In a non-limiting exemplary embodiment, strain gages are installed within the pin to measure the load placed upon the pin, and thus, upon the temporary roof support. In another embodiment, pressure sensors measure the load placed upon the hydraulics system, and thus, the temporary roof support.

In one embodiment, an unusually high load being sensed by the load detection system (e.g., the load-sensing pin) indicates that the roof has fractured and the temporary roof support is supporting loose rock. In one embodiment, when an unusually high load is measured by the load sensing system, the temporary roof support controls at the front of the machine (i.e., near the loose rock being supported by the temporary roof support) are disabled. A second set of remotely located temporary roof support controls remain operative. Thus, an operator must leave the area of danger before lowering the temporary roof support. In one embodiment, the second set of controls are located at the rear of the machine. In another embodiment, the second set of controls are configured to limit the rate of decent.

In still another embodiment, additional sensors are used to detect the presence or absence of an operator in an area of danger. In one embodiment, the additional sensor is a pressure sensor coupled to a sitting area for a roof bolter operator. In another embodiment, the additional sensor is a proximity sensor configured to detect the presence or absence of an object (e.g., an operator) in the sitting area for a roof bolter operator. In a non-limiting exemplary embodiment, when an additional sensor indicates that an operator is present in the area of danger, the second set of controls are also disabled. Thus, when loose rock is detected through a load sensing member of the temporary roof support and an operator is in an area of danger, the temporary roof support cannot be lowered.

BRIEF DESCRIPTION OF THE DRAWINGS

These and other features, aspects and advantages of the present invention will become better understood with regard to the following description, appended claims and accompanying drawings where:

DETAILED DESCRIPTION OF THE INVENTION

Figure 1A:
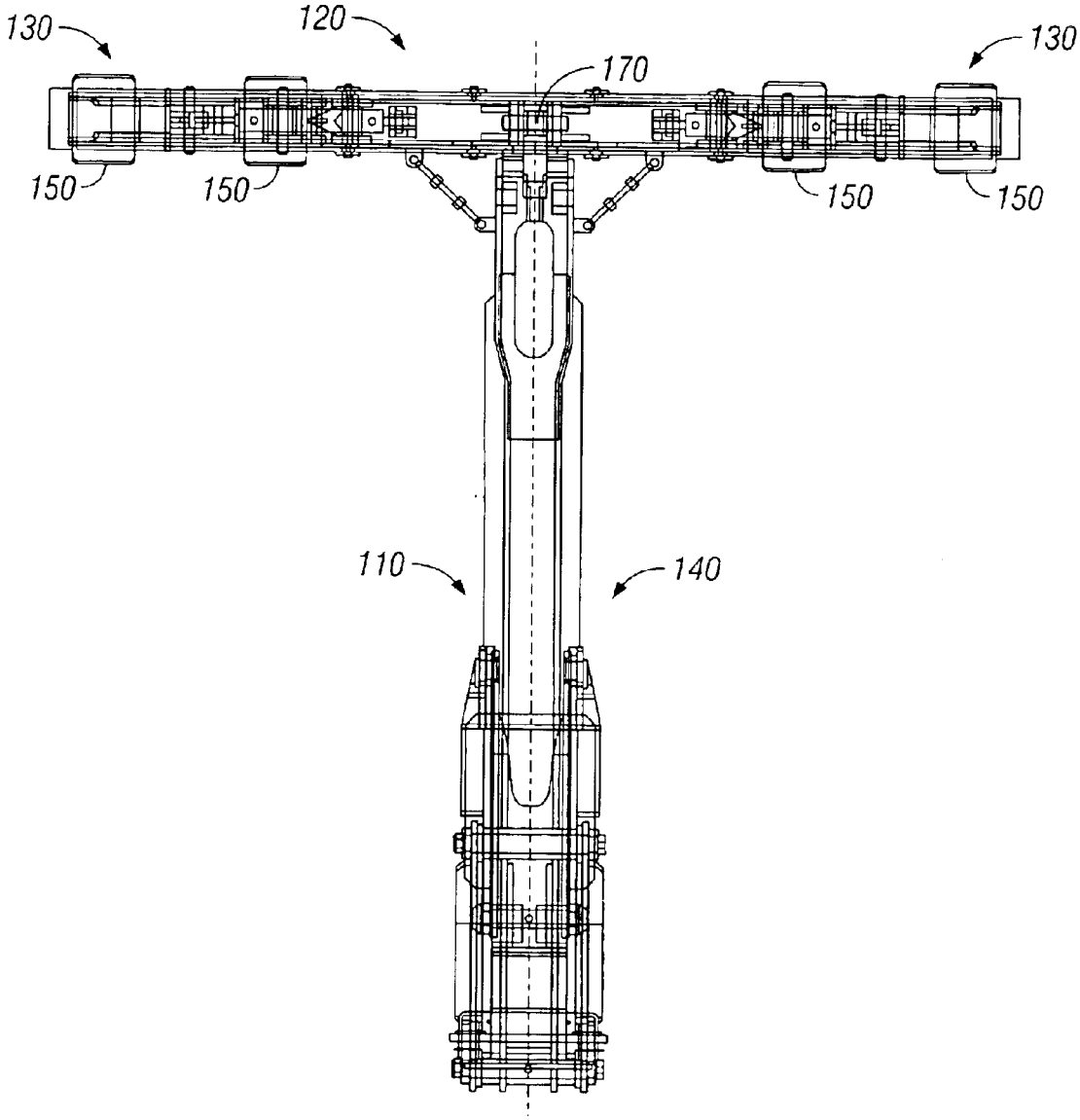
FIG. 1 is a diagram of schematics from different angles of a non-limiting, exemplary temporary roof support with a load sensing pin in part or in whole in accordance with one embodiment of the present invention.
Figure 1B:
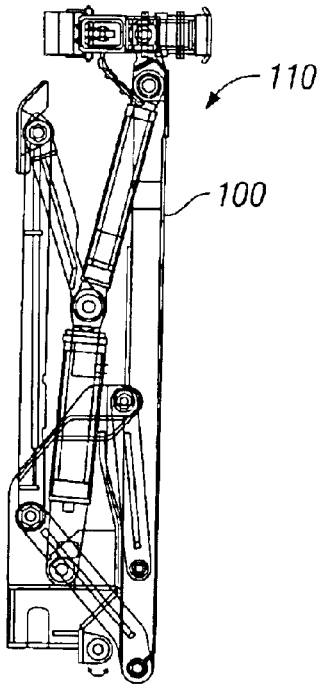
Figure 1C:
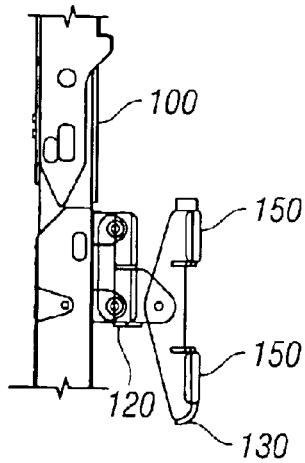
Figure 1D:
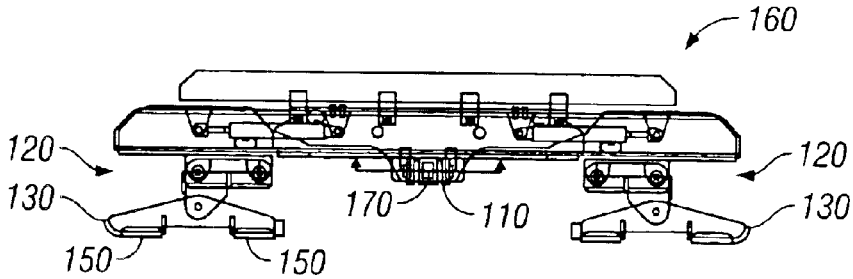
Figure 1E:
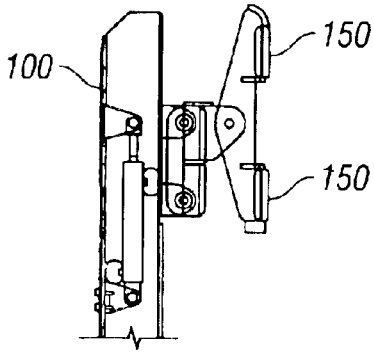
Figure 1F:
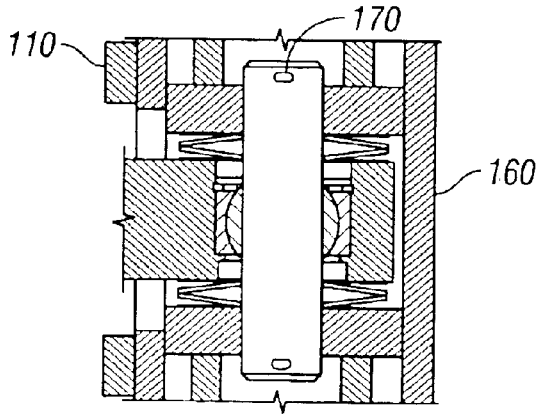

The invention is a method and apparatus for safety protection control of temporary roof support. In the following description, numerous specific details are set forth to provide a more thorough description of embodiments of the invention. It is apparent, however, to one skilled in the art, that the invention may be practiced without these specific details. In other instances, well known features have not been described in detail so as not to obscure the invention.

Load Sensing Member

In one embodiment of the present invention, a temporary roof support has a load sensing member. In a non-limiting exemplary embodiment, a beam structure of a temporary roof support is supported by a load sensing pin. The pin may be positioned at the center of the beam structure and may also be positioned on a radial ball bearing. The pin enables the beam to pivot to adapt to the inclination of the roof. In one embodiment, all loads experienced by the temporary roof support are transmitted through the pin. In a non-limiting exemplary embodiment, strain gages are installed within the pin to measure the load placed upon the pin, and thus, upon the temporary roof support. In another embodiment, pressure sensors measure the load placed upon the hydraulics system, and thus, the temporary roof support.

FIG. 1 illustrates schematics from different angles of a non-limiting, exemplary temporary roof support with a load sensing pin in part or in whole in accordance with one embodiment of the present invention. Side view 100 of the temporary roof support 110 illustrates the lifting mechanism 120 of the temporary roof support 110 as well as the roof support mechanism 130. Similarly, top view 140 illustrates lifting mechanism 120 and roof support mechanism 130. Roof support mechanism has roof pads 150 visible in front view 160. A load-sensing temporary roof support support pin 170 is located in the juncture between lifting mechanism 120 and roof support mechanism 130. The entire load experienced by temporary roof support 110 is transmitted through load sensing temporary roof support support pin 170.

Figure 2:
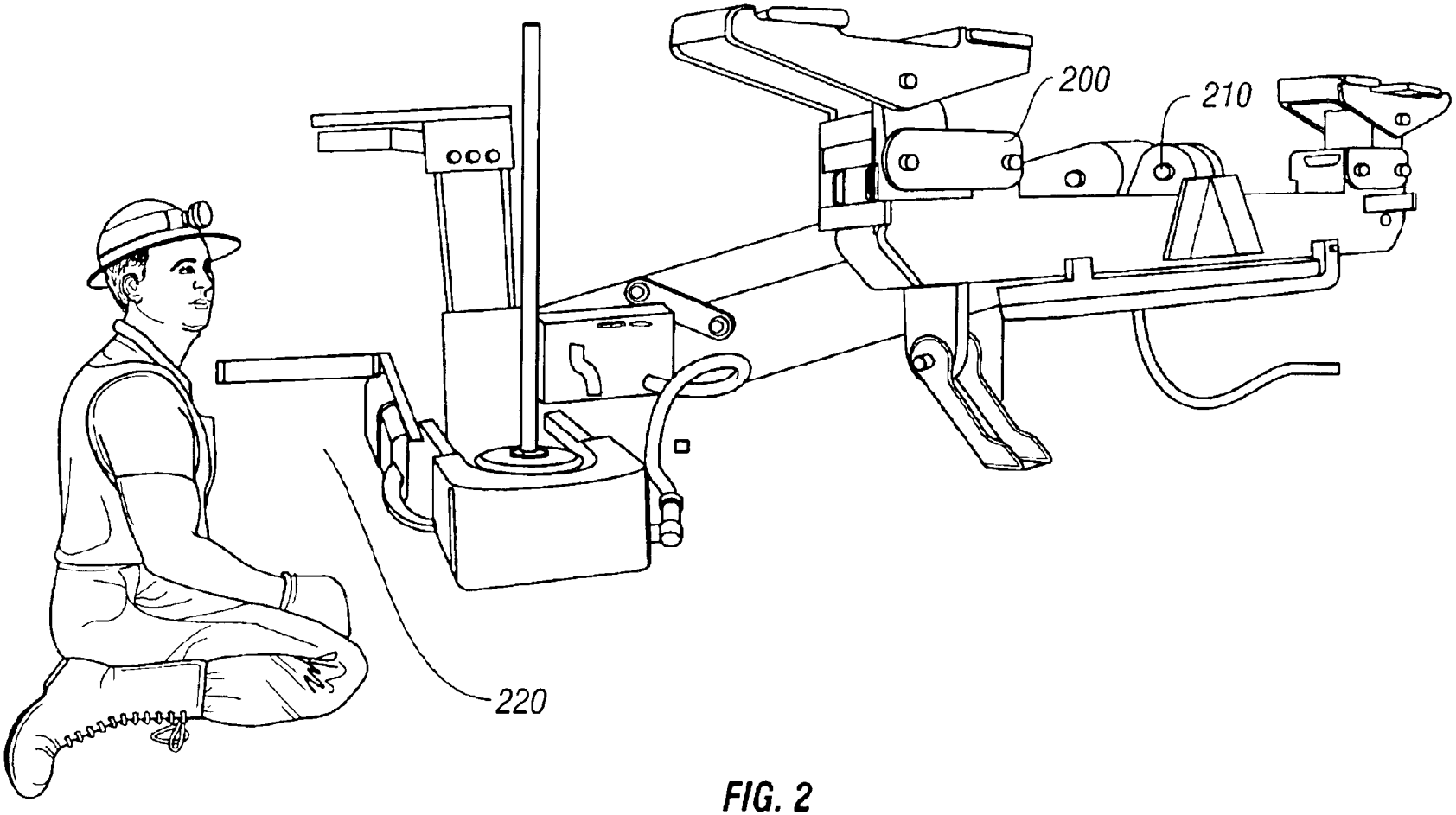
FIG. 2 is a diagram of a non-limiting, exemplary temporary roof support with a load sensing pin in a low seam in accordance with one embodiment of the present invention.

FIG. 2 illustrates a non-limiting, exemplary temporary roof support with a load sensing pin in a low seam in accordance with one embodiment of the present invention. temporary roof support assembly 200 has load-sensing temporary roof support support pin 210. The entire load experienced by the temporary roof support assembly 200 from the roof of the seam is transmitted through load-sending temporary roof support support pin 210. The temporary roof support assembly 200 is operated at the operator's forward controls 220.

Rear Secondary Controls

Figure 3:
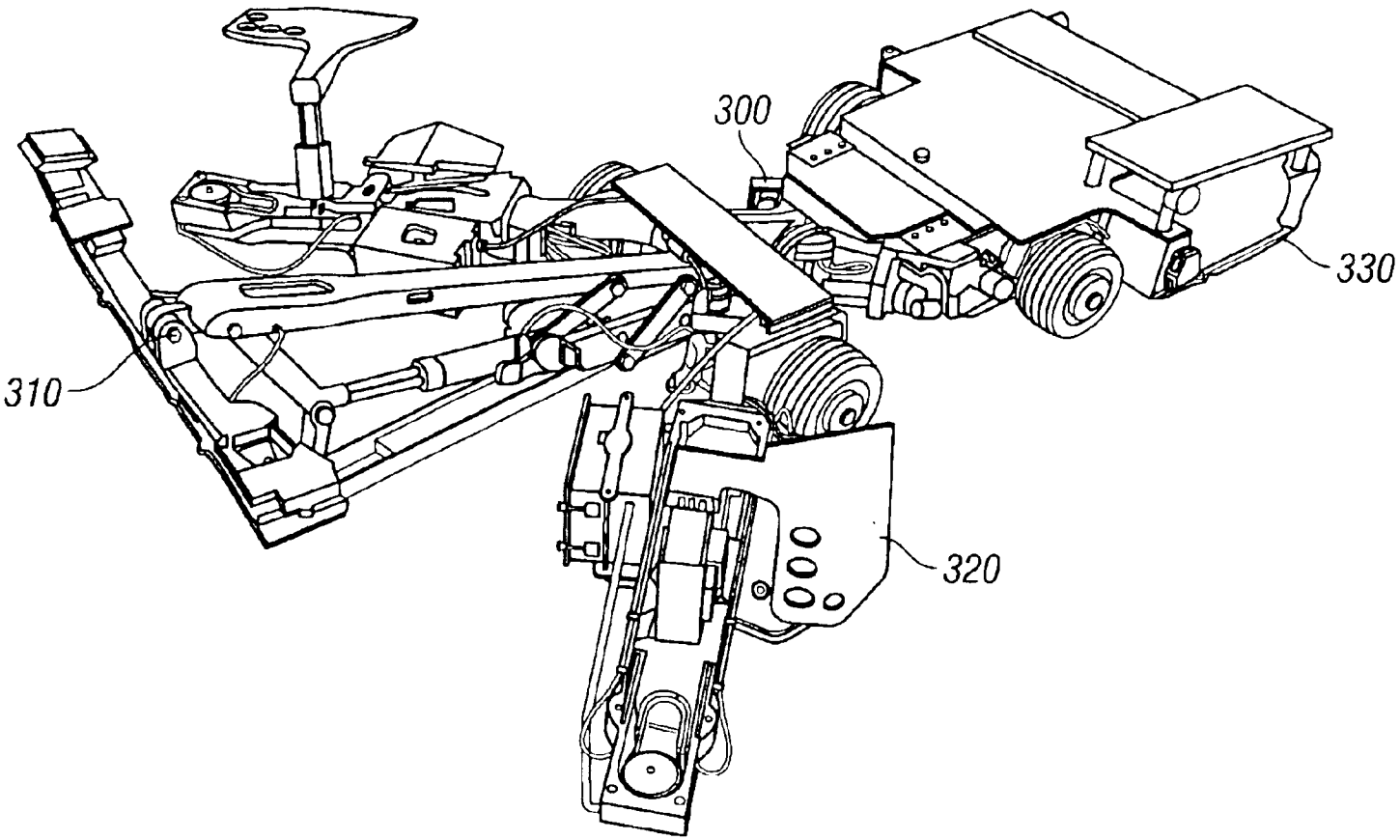
FIG. 3 is a diagram of a non-limiting, exemplary dual-boom roof bolter with a temporary roof support with a load sensing pin in accordance with one embodiment of the present invention.

FIG. 3 illustrates a non-limiting, exemplary dual-boom roof bolter with a temporary roof support with a load sensing pin in accordance with one embodiment of the present invention. The roof bolter and temporary roof support assembly 300 has a load sensing pin 310 which is used in detecting roof fractures. One boom of the roof bolter and temporary roof support assembly 300 has forward operator controls 320 which control the temporary roof support. Rear controls 330 are used to control the temporary roof support when a roof fracture is detected.

In one embodiment, an unusually high load being sensed by the load sensing system (e.g., a load sensing pin) indicates that the roof has fractured and the temporary roof support is supporting loose rock. When an unusually high load is measured by the load sensing system, the temporary roof support controls at the front of the machine (i.e., near the loose rock being supported by the temporary roof support) are disabled. In one embodiment, when a temporary roof support is raised into position, the load required to keep the temporary roof support in position is measured. That load serves as a threshold load. While the temporary roof support is in use, the load placed upon the temporary roof support is compared (e.g., by a comparator) with the threshold load. If the load on the temporary roof support exceeds the threshold load, the system determines that an unusually high load is present, indicating a roof fracture. In another embodiment, the load upon the temporary roof support must exceed the threshold load by a specific amount (e.g., 1% or 100%) before it is determined that an unusually high load exists.

In one embodiment, when an unusually high load is determined to exist, a second set of remotely located temporary roof support controls remains operative. The second set of remotely located temporary roof support controls may be part of the temporary roof support assembly, or the second set may be separate from the temporary roof support assembly and connected via a physical or wireless communications connection. Thus, an operator must leave the area of danger before lowering the temporary roof support. In one embodiment, the second set of controls is located at the rear of the machine.

Figure 4:
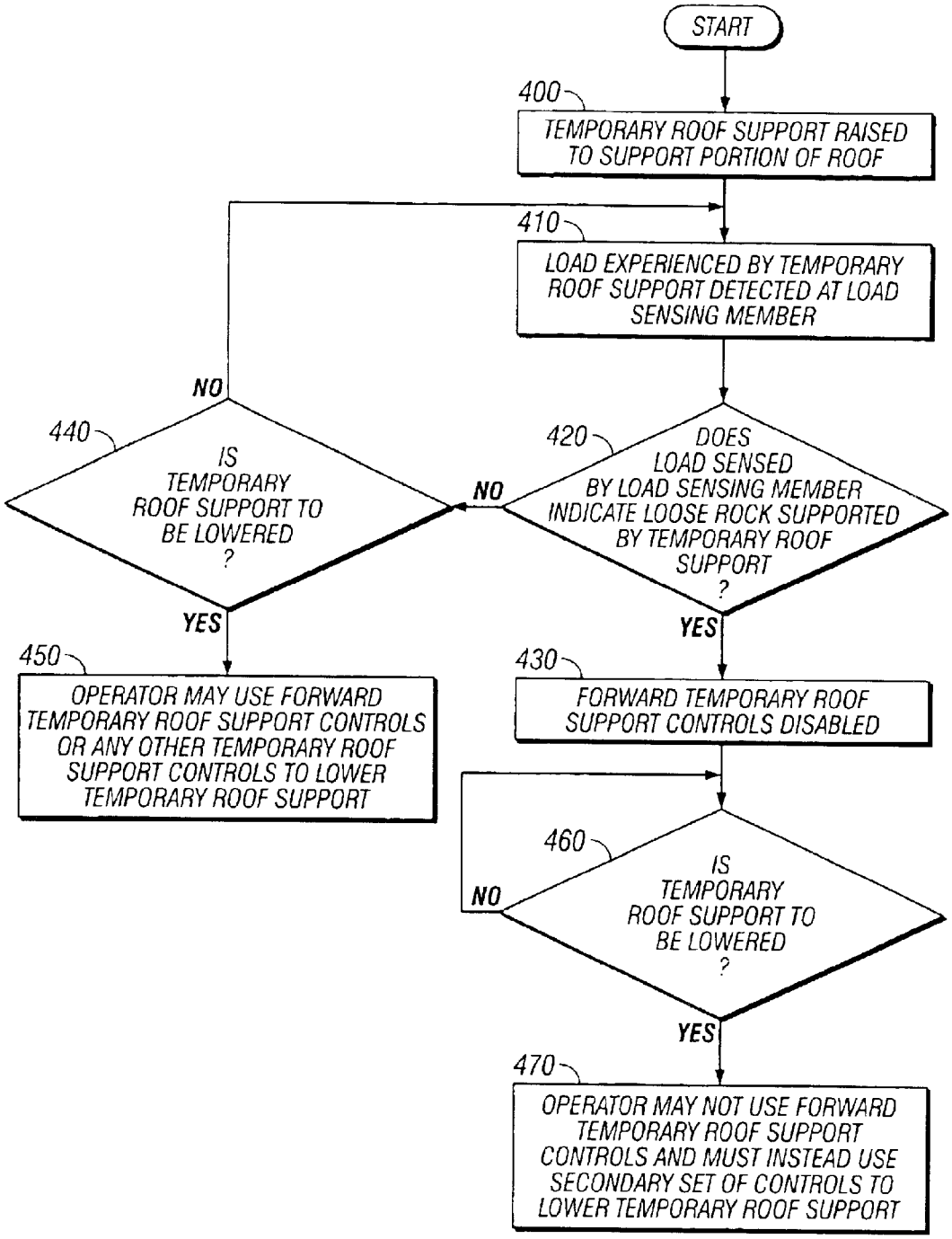
FIG. 4 is a flow diagram of a non-limiting process of operating a temporary roof support in accordance with one embodiment of the present invention.

FIG. 4 illustrates a non-limiting process of operating a temporary roof support in accordance with one embodiment of the present invention. At block 400, a temporary roof support is raised to support a portion of a roof. At block 410, the load experienced by the temporary roof support is detected at a load sensing member. At block 420, it is determined whether the load sensed by the load sensing member indicates that loose rock is supported by the temporary roof support. If the load sensed by the load sensing member indicates that loose rock is supported by the temporary roof support, at block 430, the forward temporary roof support controls are disabled and the process continues at block 460.

If the load sensed by the load sensing member does not indicate that loose rock is supported by the temporary roof support, at block 440, it is determined whether the temporary roof support is to be lowered. If the temporary roof support is to be lowered, at block 450, the operator may use the forward temporary roof support controls or any other temporary roof support controls to lower the temporary roof support. If the temporary roof support is not to be lowered, the process repeats at block 410.

At block 460, it is determined whether the temporary roof support is to be lowered. If the temporary roof support is to be lowered, at block 470, the operator may not use the forward temporary roof support controls and must instead use a secondary set of controls to lower the temporary roof support. If the temporary roof support is not to be lowered, the process repeats at block 460.

Limited Rate of Decent

In another embodiment, the second set of controls is configured to limit the rate of decent. In a non-limiting example embodiment, the second set of controls is only used when the load on the load sensing member of the temporary roof support indicates that loose rock is supported by the temporary roof support. Thus, the second set of controls may only lower the temporary roof support at the limited rate of decent. In other embodiments, the second set of controls may lower the temporary roof support at a rate greater than the limited rate of decent. In still other embodiments, the second set of controls are not just used when the load sensing member of the temporary roof support indicates that loose rock is supported by the temporary roof support.

Figure 5:
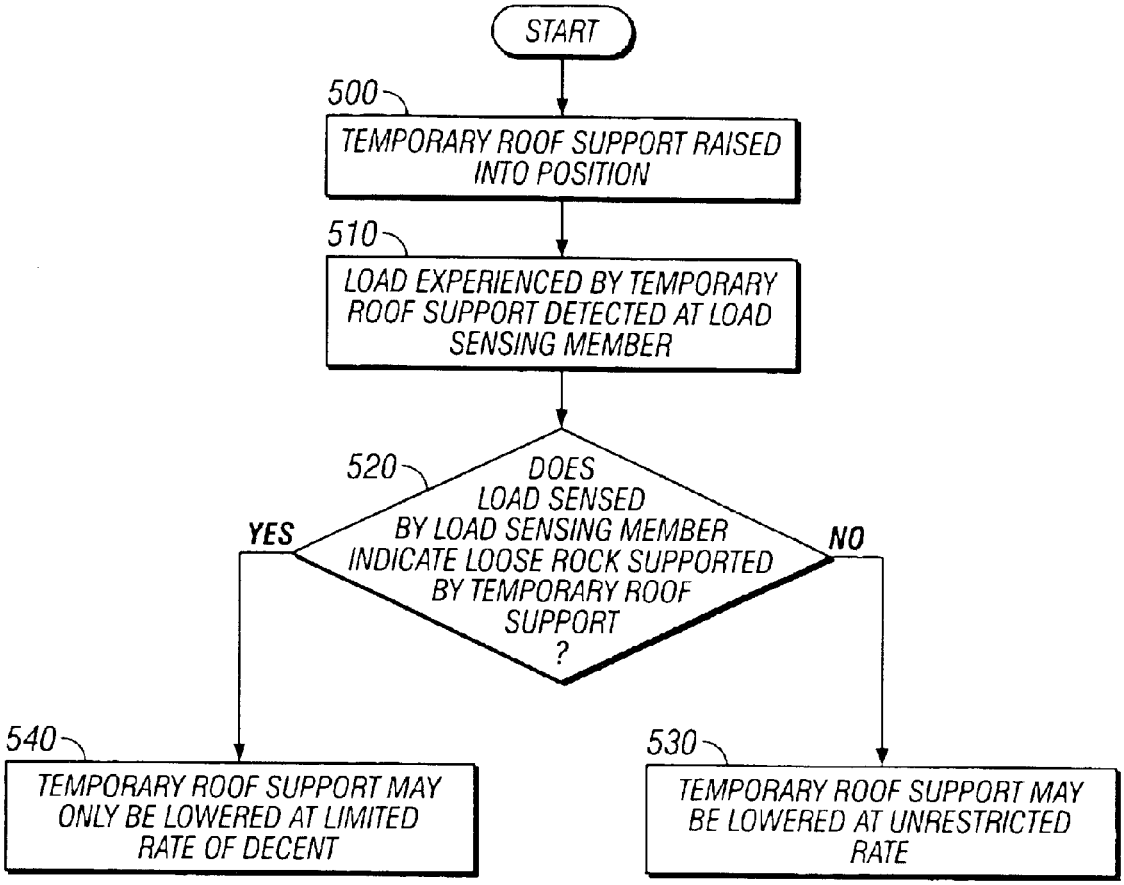
FIG. 5 is a flow diagram of a non-limiting process of lowering a temporary roof support in accordance with one embodiment of the present invention.

FIG. 5 illustrates a non-limiting process of lowering a temporary roof support in accordance with one embodiment of the present invention. At block 500, the temporary roof support is raised into position. At block 510, the load experienced by the temporary roof support is detected at a load sensing member. At block 520, it is determined whether the load sensed by the load sensing member indicates that loose rock is supported by the temporary roof support. If the load sensed by the load sensing member does not indicate that loose rock is supported by the temporary roof support, at block 530, the temporary roof support may be lowered at an unrestricted rate. If the load sensed by the load sensing member indicates that loose rock is supported by the temporary roof support, at block 540, the temporary roof support may only be lowered at a limited rate of decent.

Additional Safety Measures

In still another embodiment, additional sensors are used to detect the presence or absence of an operator in an area of danger (e.g., the forward operator areas on a roof bolter and/or temporary roof support device). In one embodiment, the additional sensor is a pressure sensor coupled to a sitting area for a roof bolter operator. In another embodiment, the additional sensor is a proximity sensor configured to detect the presence or absence of an object (e.g., an operator) in the sitting area for a roof bolter operator. In a non-limiting exemplary embodiment, when an additional sensor indicates that an operator is present in the area of danger, the second set of controls are also disabled. Thus, when loose rock is detected through a load sensing member of the temporary roof support and an operator is in an area of danger, the temporary roof support cannot be lowered. In one embodiment, the control logic is implemented using a programmable logic array. In another embodiment, the control logic is implemented using specific purpose circuitry (e.g., a custom chip or other electronic circuit).

Figure 6:
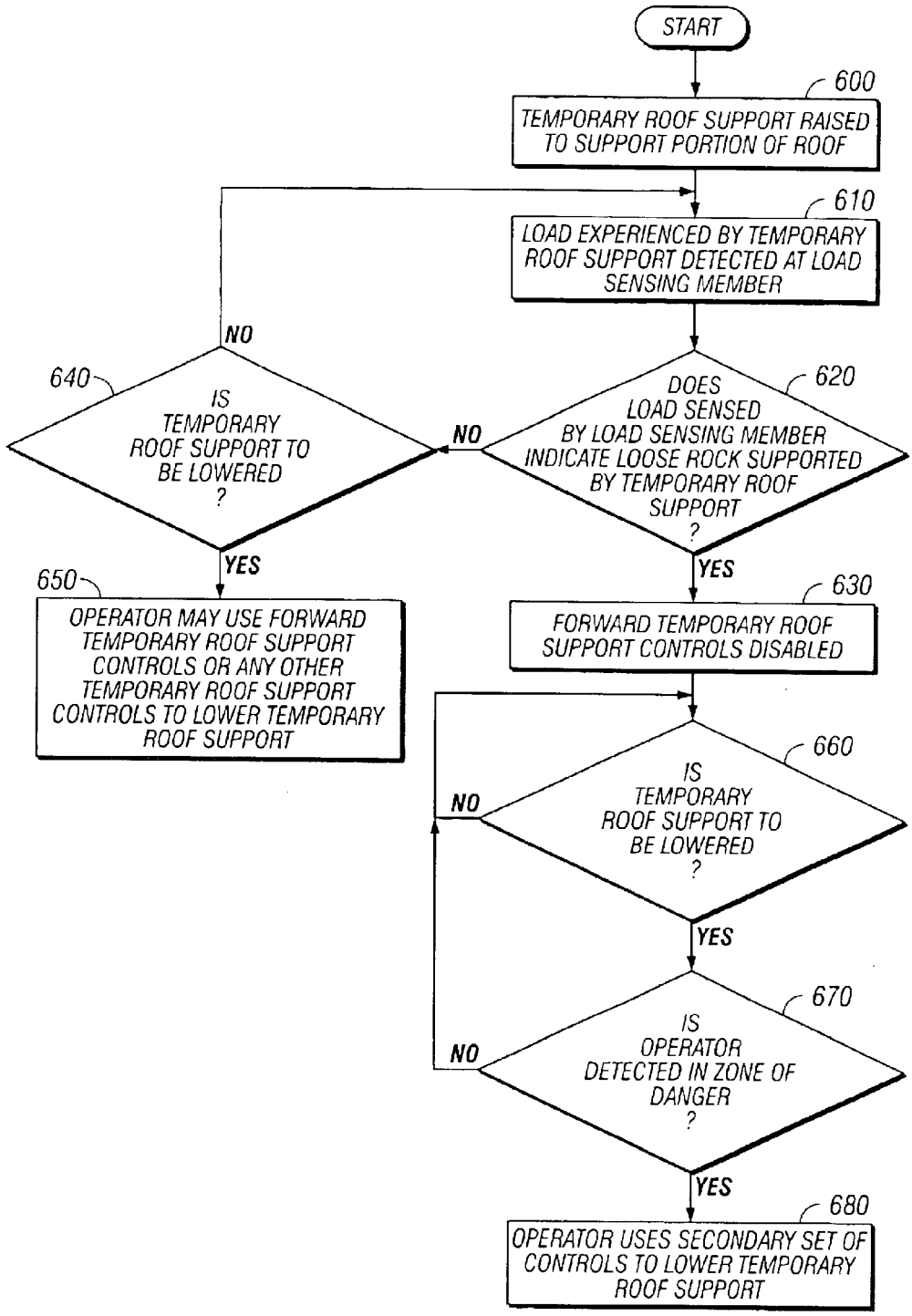
FIG. 6 is a flow diagram of a non-limiting process of operating a temporary roof support with operator-detecting safety features in accordance with one embodiment of the present invention.

FIG. 6 illustrates a non-limiting process of operating a temporary roof support with operator-detecting safety features in accordance with one embodiment of the present invention. At block 600, a temporary roof support is raised to support a portion of a roof. At block 610, the load experienced by the temporary roof support is detected at a load sensing member. At block 620, it is determined whether the load sensed by the load sensing member indicates that loose rock is supported by the temporary roof support. If the load sensed by the load sensing member indicates that loose rock is supported by the temporary roof support, at block 630, the forward temporary roof support controls are disabled and the process continues at block 660.

If the load sensed by the load sensing member does not indicate that loose rock is supported by the temporary roof support, at block 640, it is determined whether the temporary roof support is to be lowered. If the temporary roof support is to be lowered, at block 650, the operator may use the forward temporary roof support controls or any other temporary roof support controls to lower the temporary roof support. If the temporary roof support is not to be lowered, the process repeats at block 610.

At block 660, it is determined whether the temporary roof support is to be lowered. If the temporary roof support is to be lowered, at block 670, it is determined whether an operator is detected in a zone of danger. If an operator is detected in the zone of danger, the process repeats at block 660. If no operator is detected in the zone of danger, at block 680, the operator uses a secondary set of controls to lower the temporary roof support. If the temporary roof support is not to be lowered, the process repeats at block 660.

Load Sensing Pin

Figure 7:
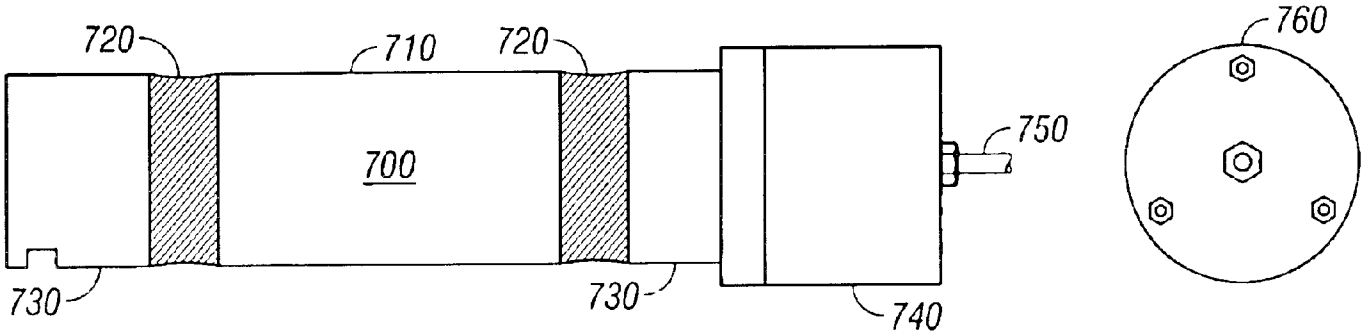
FIG. 7 is a block diagram of a load sensing pin in accordance with one embodiment of the present invention.

FIG. 7 illustrates a load sensing pin in accordance with one embodiment of the present invention. Load sensing pin 700 has supporting surface 710 and loading surfaces 730 with load sensing systems 720 between them. Terminal back 740 connects load sensing pin 700 with cable 750. Cable 750 carries the signals from load sensing pin 700 to unit that controls which set of temporary roof support controls functions. FIG. 7 also illustrates end on view 760 of load sensing pin 700.

Figure 8:
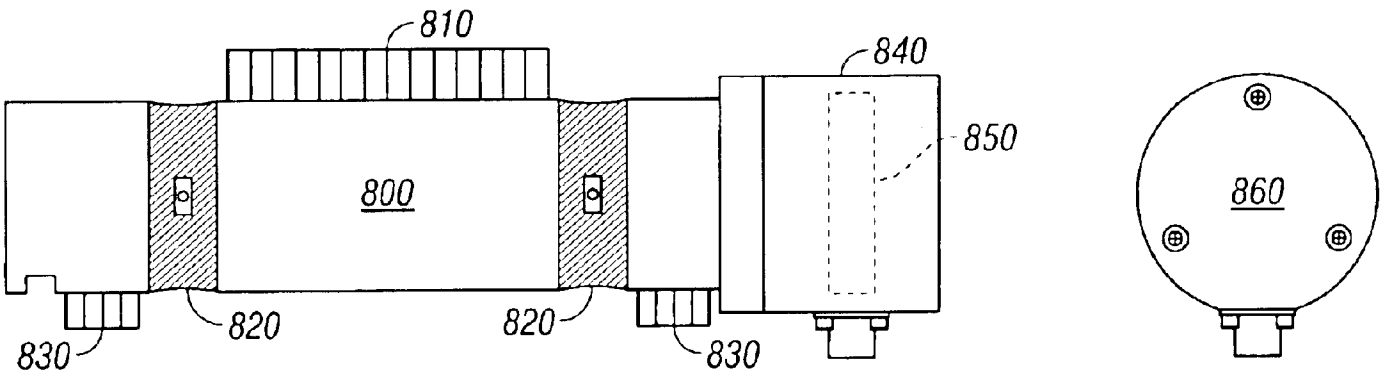
FIG. 8 is a block diagram of another load sensing pin in accordance with one embodiment of the present invention.

FIG. 8 illustrates another load sensing pin in accordance with one embodiment of the present invention. Load sensing pin 800 has supporting surface 810 and loading surfaces 830 with load sensing systems 820 between them. Terminal back 840 has voltage converter 850. FIG. 8 also illustrates end on view 860 of load sensing pin 800.

In one embodiment, the load sensing pin is made from a high strength aluminum alloy and weighs 52 lbs including ramps and 42 without ramps. The load sensing pin has a rated capacity of up to twenty tons per pad, a static accuracy of 0.25% fill scale or better, and a dynamic accuracy of plus or minus 1% of full scale with leveling track or plus or minus 3% of full scale without leveling track. The load sensing pin also has an overload capacity of 200% of full scale, an input/output resistance of 560 ohms plus or minus 50 ohms, an output of 0.6 to 1.0 mV per V, an excitation of 5 to 15 VDC, a stability of 0.5% of full scale per year, a ground level requirement of less than an eighth of an inch within four square feet, and a compensated temperature range of −10 to 50 degrees Celsius.

Figure 9:
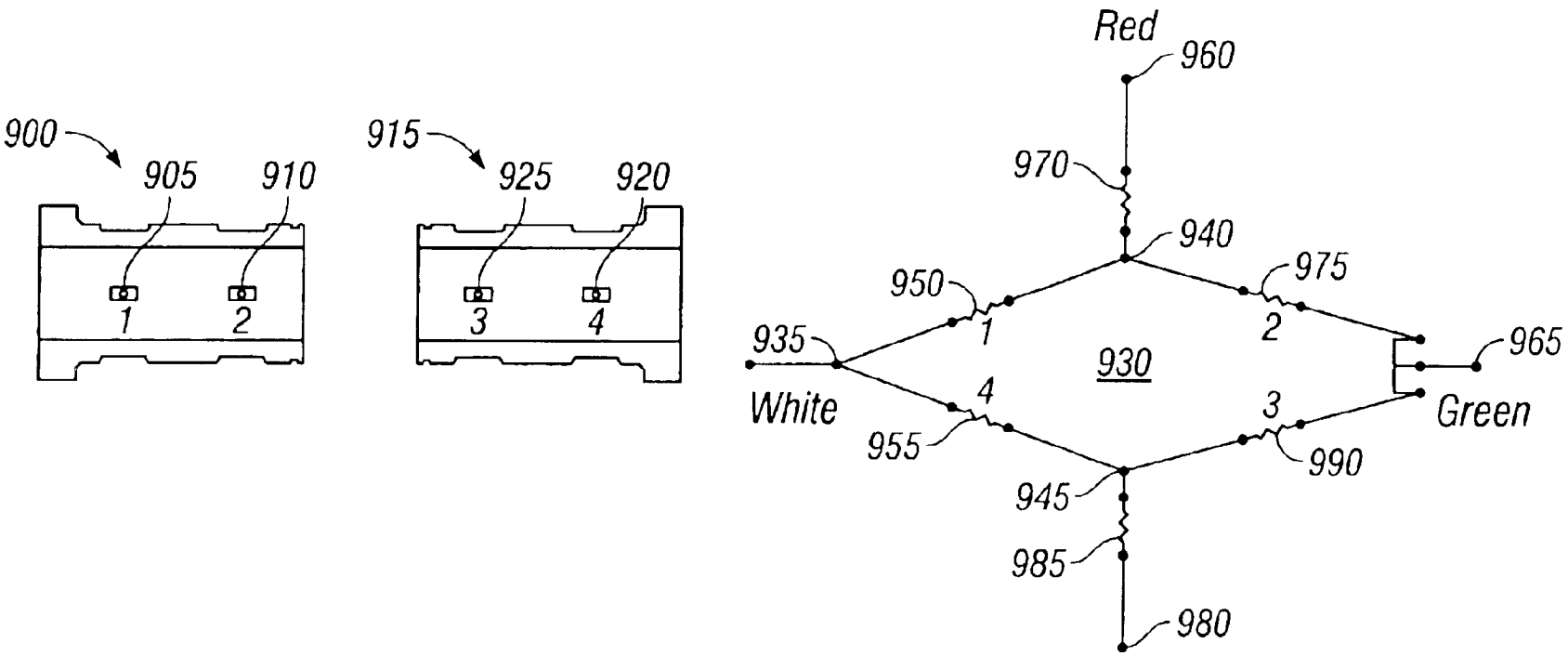
FIG. 9 is a block diagram of two half sectional views and a circuit diagram of a load sensing pin.

FIG. 9 illustrates two half sectional views and a circuit diagram of a load sensing pin. In left sectional view 900, load sensitive elements 905 and 910 are visible. In right sectional view 915, load sensitive elements 920 and 925 are visible. In circuit diagram 930, current is supplied at point 935. Point 935 is coupled to points 940 and 945. Between points 935 and 940 is resistor 950. Resistor 950 corresponds to load sensitive element 905. Between points 935 and 945 is resistor 955. Resistor 955 corresponds to load sensitive element 920.

Point 940 is also coupled to points 960 and 965. Resistor 970 is between points 940 and 960, and resistor 975 is between points 940 and 965. Resistor 975 corresponds to load sensitive element 910. Point 945 is also coupled to points 965 and 980. Resistor 985 is between points 945 and 980, and resistor 990 is between points 945 and 965. Resistor 990 corresponds to load sensitive element 925. When a load is places upon the load sensing pin, load sensitive elements 905, 910, 920, and 925 are either compressed or stretched depending upon where the load is placed, and the degree of compression or stretching depends upon the amount of load. Stretching or compressing a load sensing element changes its resistance in a known manner. Thus, by measuring the changes in resistance of resistors 950, 955, 975, and 990, the system determines the amount of load placed upon the load sensing pin.

Excessive Load Detection Unit

Figure 10:
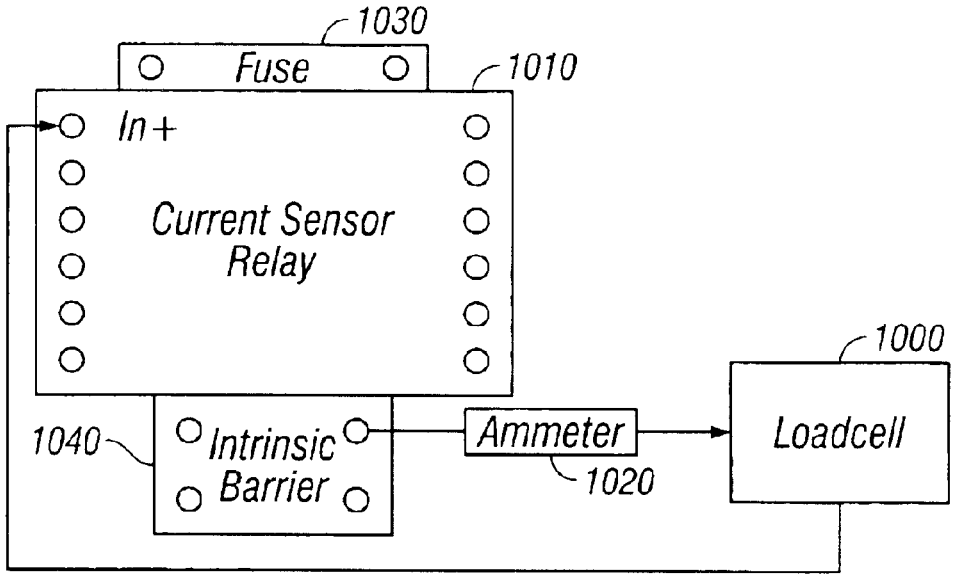
FIG. 10 is a block diagram of an excessive load detection unit in accordance with one embodiment of the present invention.

FIG. 10 illustrates an excessive load detection unit in accordance with one embodiment of the present invention. A loop is formed between loadcell 1000, current sensor relay 1010, and ammeter 1020. Current sensor relay 1010 also has fuse 1030 and intrinsic barrier 1040 to protect portions of the circuit from overloading. A load is measured at loadcell 1000 and a signal is returned to current sensor relay 1010. The signal is compared with the threshold signal to determine whether a load that exceeds the threshold is present.

Figure 11:
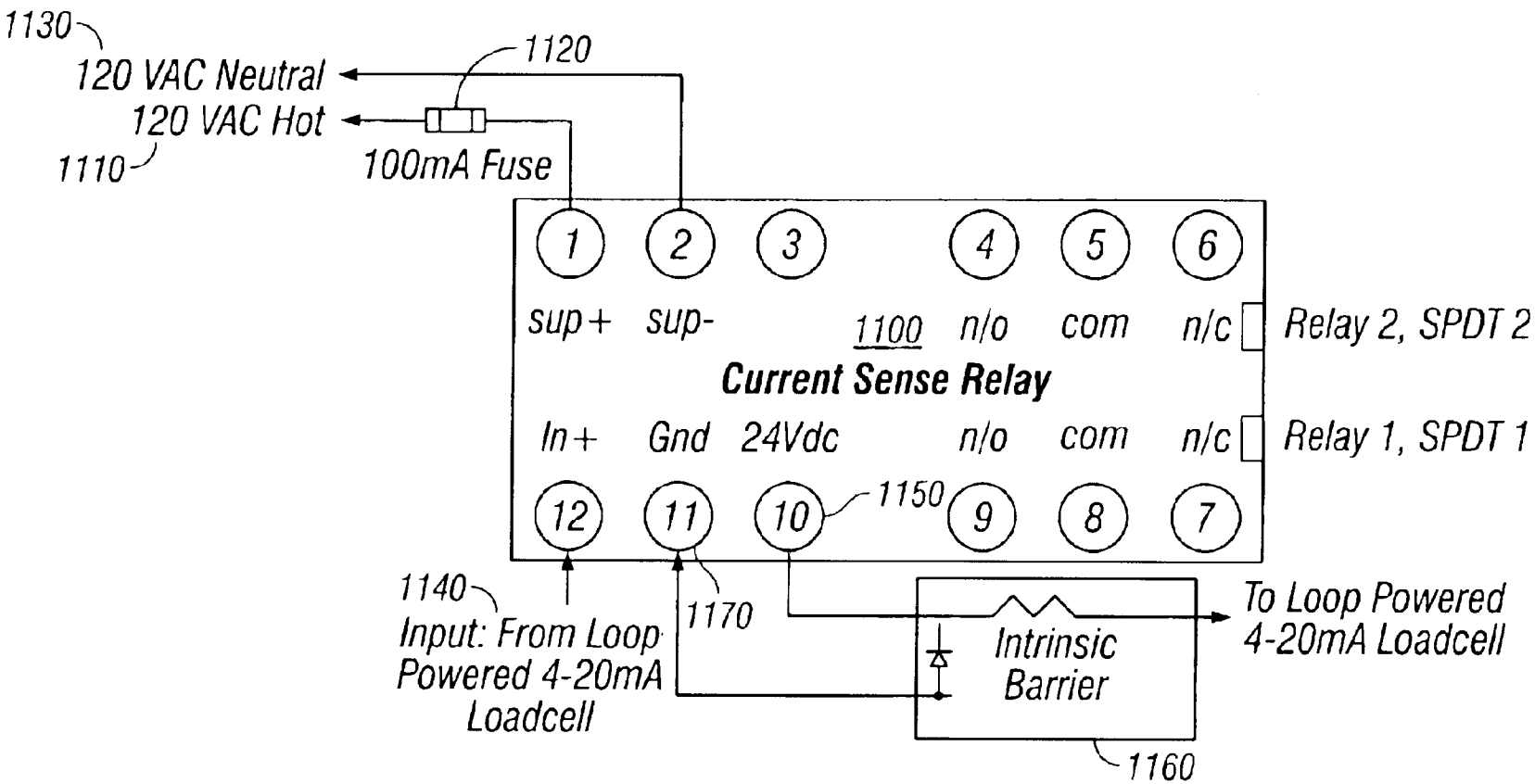
FIG. 11 is a block diagram of a current sensor relay in accordance with one embodiment of the present invention.

FIG. 11 illustrates a current sensor relay in accordance with one embodiment of the present invention. Power is supplied to current sensor relay 100 through 120 V AC hot line 1110 coupled to a 100 mA fuse 1120 paired with 120 V AC neutral line 1130. Current sensor relay 1100 receives input signal 1140 from a load detecting unit. The input signal is analyzed to determine whether an excessive load is present. 24 V DC signal 1150 passes through intrinsic barrier 1160 to the load detecting unit. Intrinsic barrier 1160 is also coupled to ground 1170.

In one embodiment, the current sensor relay provides two alarms with set points of Lo=1100 lbs and Hi=2200 lbs. The supply voltage is 100 to 130 Volts AC at 50 to 60 Hz. The current sensor relay has a maximum rating of 100 Milliamps or 1 W, an input range of 0 to 20 mA with 50 ohms input impedance, a field device excitation of 24 V DC at 25 mA, two independent set points of Hi or Lo, and an output load of 5 A at 240 V AC or 5 A at 24 V DC (resistive load). In one embodiment, the intrinsic barrier has a maximum voltage of 35 V DC and a maximum current of 75 mA.

Figure 12:
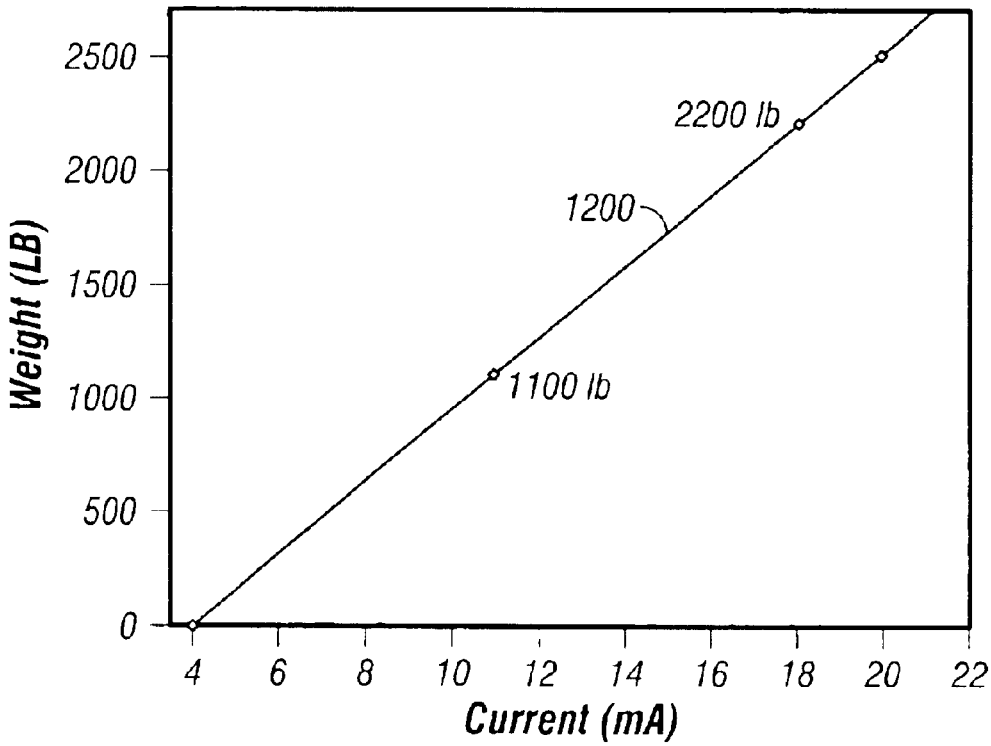
FIG. 12 is a block diagram of a graph of load in pounds versus current in mA in accordance with one embodiment of the present invention.

FIG. 12 illustrates a graph of load in pounds versus current in mA in accordance with one embodiment of the present invention. Curve 1200 is substantially linear in the region between 4 and 20 mA. Thus, the load upon the load sensing unit can be determined by measuring the current returned to the current sensor relay.

Embodiment of Computer Execution Environment (Hardware)

Figure 13:
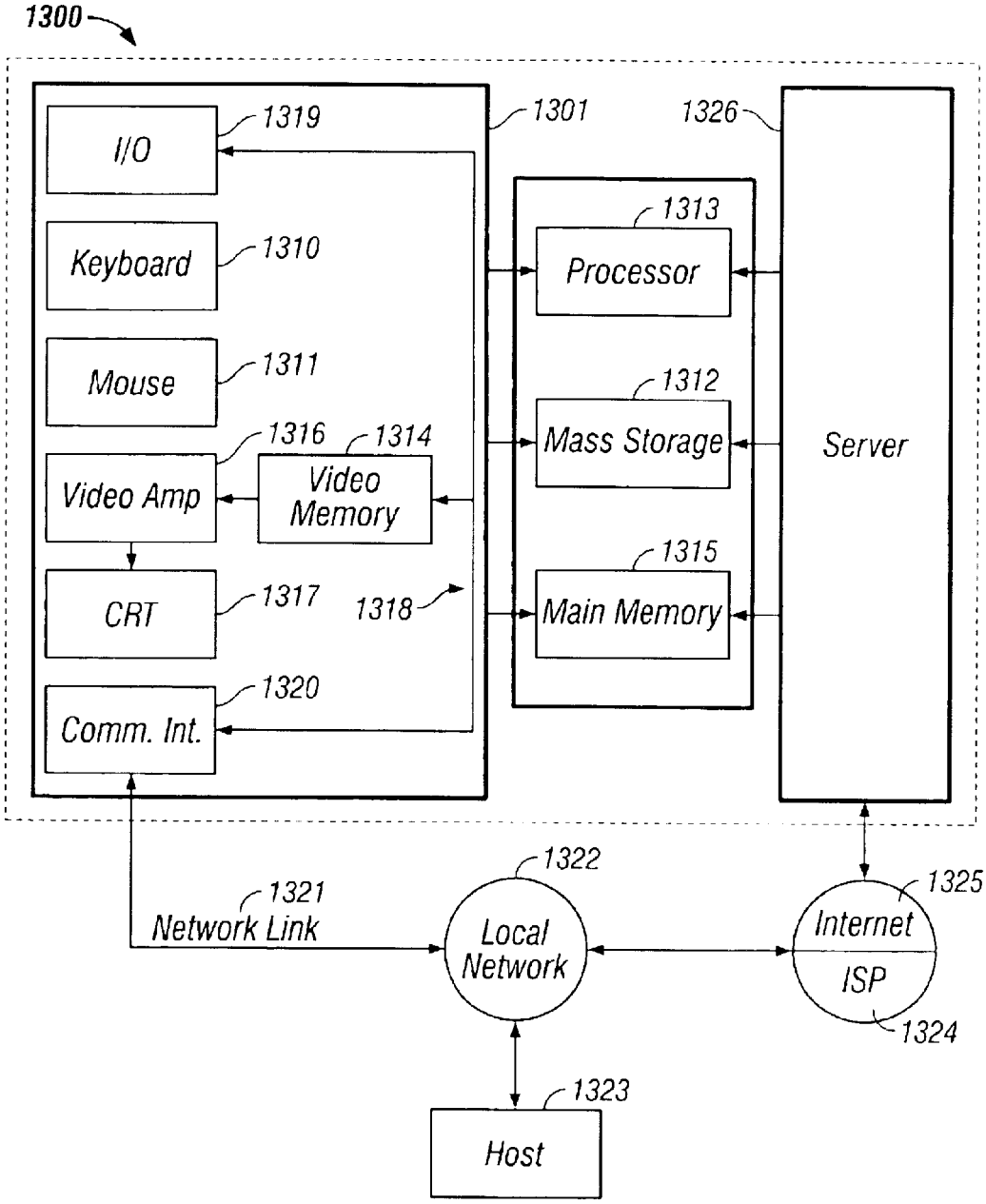
FIG. 13 is a block diagram of a non-limiting general purpose computer in accordance with one embodiment of the present invention.

An embodiment of the invention can be implemented as computer software in the form of computer readable program code executed in a general purpose computing environment such as environment 1300 illustrated in FIG. 13. A keyboard 1310 and mouse 1311 are coupled to a system bus 1318. The keyboard and mouse are for introducing user input to the computer system and communicating that user input to central processing unit (CPU) 1313. Other suitable input devices may be used in addition to, or in place of, the mouse 1311 and keyboard 1310. I/O (input/output) unit 1319 coupled to bi-directional system bus 1318 represents such I/O elements as a printer, A/V (audio/video) I/O, etc.

Computer 1301 may include a communication interface 1320 coupled to bus 1318. Communication interface 1320 provides a two-way data communication coupling via a network link 1321 to a local network 1322. For example, if communication interface 1320 is an integrated services digital network (ISDN) card or a modem, communication interface 1320 provides a data communication connection to the corresponding type of telephone line, which comprises part of network link 1321. If communication interface 1320 is a local area network (LAN) card, communication interface 1320 provides a data communication connection via network link 1321 to a compatible LAN. Wireless links are also possible. In any such implementation, communication interface 1320 sends and receives electrical, electromagnetic or optical signals which carry digital data streams representing various types of information.

Network link 1321 typically provides data communication through one or more networks to other data devices. For example, network link 1321 may provide a connection through local network 1322 to local server computer 1323 or to data equipment operated by ISP 1324. ISP 1324 in turn provides data communication services through the world wide packet data communication network now commonly referred to as the "Internet" 1325. Local network 1322 and Internet 1325 both use electrical, electromagnetic or optical signals which carry digital data streams. The signals through the various networks and the signals on network link 1321 and through communication interface 1320, which carry the digital data to and from computer 1300, are exemplary forms of carrier waves transporting the information.

Processor 1313 may reside wholly on client computer 1301 or wholly on server 1326 or processor 1313 may have its computational power distributed between computer 1301 and server 1326. Server 1326 symbolically is represented in FIG. 13 as one unit, but server 1326 can also be distributed between multiple "tiers". In one embodiment, server 1326 comprises a middle and back tier where application logic executes in the middle tier and persistent data is obtained in the back tier. In the case where processor 1313 resides wholly on server 1326, the results of the computations performed by processor 1313 are transmitted to computer 1301 via Internet 1325, Internet Service Provider (ISP) 1324, local network 1322 and communication interface 1320. In this way, computer 1301 is able to display the results of the computation to a user in the form of output.

Computer 1301 includes a video memory 1314, main memory 1315 and mass storage 1312, all coupled to bi-directional system bus 1318 along with keyboard 1310, mouse 1311 and processor 1313. As with processor 1313, in various computing environments, main memory 1315 and mass storage 1312, can reside wholly on server 1326 or computer 1301, or they may be distributed between the two.

The mass storage 1312 may include both fixed and removable media, such as magnetic, optical or magnetic optical storage systems or any other available mass storage technology. Bus 1318 may contain, for example, thirty-two address lines for addressing video memory 1314 or main memory 1315. The system bus 1318 also includes, for example, a 32-bit data bus for transferring data between and among the components, such as processor 1313, main memory 1315, video memory 1314 and mass storage 1312. Alternatively, multiplex data/address lines may be used instead of separate data and address lines.

In one embodiment of the invention, the microprocessor is manufactured by Intel, such as the 80×86 or Pentium-typed processor. However, any other suitable microprocessor or microcomputer may be utilized. Main memory 1315 is comprised of dynamic random access memory (DRAM). Video memory 1314 is a dual-ported video random access memory. One port of the video memory 1314 is coupled to video amplifier 1316. The video amplifier 1316 is used to drive the cathode ray tube (CRT) raster monitor 1317. Video amplifier 1316 is well known in the art and may be implemented by any suitable apparatus. This circuitry converts pixel data stored in video memory 1314 to a raster signal suitable for use by monitor 1317. Monitor 1317 is a type of monitor suitable for displaying graphic images.

Computer 1301 can send messages and receive data, including program code, through the network(s), network link 1321, and communication interface 1320. In the Internet example, remote server computer 1326 might transmit a requested code for an application program through; Internet 1325, ISP 1324, local network 1322 and communication interface 1320. The received code may be executed by processor 1313 as it is received, and/or stored in mass storage 1312, or other non-volatile storage for later execution. In this manner, computer 1300 may obtain application code in the form of a carrier wave. Alternatively, remote server computer 1326 may execute applications using processor 1313, and utilize mass storage 1312, and/or video memory 1315. The results of the execution at server 1326 are then transmitted through Internet 1325, ISP 1324, local network 1322 and communication interface 1320. In this example, computer 1301 performs only input and output functions.

Application code may be embodied in any form of computer program product. A computer program product comprises a medium configured to store or transport computer readable code, or in which computer readable code may be embedded. Some examples of computer program products are CD-ROM disks, ROM cards, floppy disks, magnetic tapes, computer hard drives, servers on a network, and carrier waves.

The computer systems described above are for purposes of example only. An embodiment of the invention may be implemented in any type of computer system or programming or processing environment.

Thus, a method and apparatus for safety protection control of temporary roof support is described in conjunction with one or more specific embodiments. The invention is defined by the following claims and their full scope and equivalents.

We claim:

1. A method for securing a structure comprising the steps of:

positioning a brace against said structure;

detecting a load on said brace at a load sensing member; and disabling a controller if it is determined from said load that a portion of said structure will collapse if said brace is removed.

2. The method of claim 1 further comprising the steps of:

disabling a second controller if it is determined that an operator is present in a zone of danger.

3. The method of claim 1 wherein said structure is a ceiling of an excavated cavity.

4. The method of claim 1 wherein said load sensing member is a load sensing pin.

5. The method of claim 1 wherein said load sensing member is a pressure sensor coupled to a hydraulic system.

6. The method of claim 1 wherein all of said load is transmitted through said load sensing member.

7. The method of claim 1 further comprising the steps of:

disabling a second controller if it is determined that an operator is present in a zone of danger, wherein said structure is a ceiling of an excavated cavity, wherein said load sensing member is a load sensing pin, and wherein all of said load is transmitted through said load sensing member.

8. A structural bracing system comprising:

a brace configured to be positioned against a structure;

a load sensing member configured to detect a load on said brace; and a control disabling unit configured to disable a controller if it is determined from said load that a portion of said structure will collapse if said brace is removed.

9. The structural bracing system of claim 8 further comprising:

a second control disabling unit configured to disable a second controller if it is determined that an operator is present in a zone of danger.

10. The structural bracing system of claim 8 wherein said structure is a ceiling of excavated cavity.

11. The structural bracing system of claim 8 wherein said load sensing member is a load sensing pin.

12. The structural bracing system of claim 8 wherein said load sensing member is a pressure sensor coupled to a hydraulic system.

13. The structural bracing system of claim 8 wherein all of said load is transmitted through said load sensing member.

14. The structural bracing system of claim 8 further comprising:

a second control disabling unit configured to disable a second controller if it is determined that an operator is present in a zone of danger, wherein said structure is a ceiling of an excavated cavity, wherein said load sensing member is a load sensing pin, and wherein all of said load is transmitted through said load sensing member.

* * * * *